United States Patent [19]

Shioi et al.

[11] Patent Number: 4,704,379

[45] Date of Patent: Nov. 3, 1987

[54] PRESSURE SENSITIVE MANIFOLD SHEET

[75] Inventors: Shunsuke Shioi, Ikoma; Kazuyuki Shinmitsu, Osaka; Nobuo Kanda, Hirakata; Mitsuru Kondo, Hyogo; Makoto Miyake, Ashiya, all of Japan

[73] Assignee: Kanzaki Paper Manufacturing Co. Ltd., Tokyo, Japan

[21] Appl. No.: 835,749

[22] Filed: Mar. 3, 1986

[30] Foreign Application Priority Data

Mar. 6, 1985 [JP] Japan ..... 60-45106

[51] Int. Cl.[4] ..... B41M 5/16; B41M 5/22

[52] U.S. Cl. ..... 503/211; 427/150; 427/151; 503/209; 503/217; 503/220; 503/221; 503/226

[58] Field of Search ..... 427/150–152; 503/208, 209, 211, 216, 217, 220, 221, 226

[56] References Cited

U.S. PATENT DOCUMENTS

| | | | |
|---|---|---|---|
| 4,020,056 | 4/1977 | Farber | 260/240 D |
| 4,107,428 | 8/1978 | Farber | 542/437 |
| 4,533,930 | 8/1985 | Shioi et al. | 503/211 |
| 4,580,153 | 4/1986 | Kondo et al. | 346/220 |

FOREIGN PATENT DOCUMENTS

| | | | |
|---|---|---|---|
| 0062544 | 10/1982 | European Pat. Off. | 346/220 |

*Primary Examiner*—Bruce H. Hess

*Attorney, Agent, or Firm*—Murray and Whisenhunt

[57] ABSTRACT

A pressure sensitive manifold sheet characterized in that a chelate record material comprising an iron (III) compound and/or a vanadium compound, and an aromatic compound having at least one of hydroxyl group and mercapto group on the aromatic ring in combination therewith is used further in combination with an infrared absorbing organic compound.

20 Claims, No Drawings

PRESSURE SENSITIVE MANIFOLD SHEET

The present invention relates to pressure sensitive manifold paper having outstanding characteristics for use with optical character- or mark-reading devices and further having high lightfastness and excellent resistance to plasticizers.

Pressure sensitive manifold sheet is known which has a leuco-type record material incorporated therein. Such a record material comprises the combination of an electron donating chromogenic material (hereinafter referred to as "chromogenic material") typical of which are crystal violet lactone, benzoyl-leucomethylene blue and the like, and an electron accepting acidic reactant material (hereinafter referred to as "color acceptor") such as activated clay, phenolic resin, polyvalent metal salt of aromatic carboxylic acid or the like. For transfer type pressure sensitive manifold sheet, sheets are used in a suitable combination which include a top sheet (CB) comprising a substrate and an oil transfer layer formed on the rear surface of the substrate and containing a microcapsule of chromogenic material (or color acceptor), an under sheet (CF) comprising a substrate and an oil accepting layer formed on the front surface of the substrate and containing a color acceptor (or chromogenic material), and a middle sheet (CFB) comprising a substrate provided with an oil accepting layer and an oil transfer layer separately on the opposite surfaces thereof. Middle sheets are used for making a multiplicity of copies. Pressure sensitive manifold sheet of the self-contained type comprises a substrate which is coated on one surface thereof with microcapsules containing a chromogenic material (or color acceptor) and a color acceptor (or chromogenic material) in the form of superposed layers or a layer of the mixture of two materials. The pressure sensitive manifold sheet of the latter type may be coated with a capsule layer on the rear surface for use with the under sheet or middle sheet in a suitable combination.

With a trend toward more efficient office work in recent years, optical character- or mark-reading devices (hereinafter referred to simply as "optical readers") are in greatly increasing use for reading the record images on record media. The record images (such as black images, blue images, red images, green images, etc.) on the pressure sensitive manifold sheet are legible as a leading color by optical readers having a reading wavelength range over the visible region (400 to 700 nm), but for optical readers having a reading wavelength range over the infrared region (700 to 900 nm), such images function as drop-out color irrespective of the color of the image and can not be read by the reader.

Record media for use with optical readers are generally in the form of slips. These slips have printed thereon instructions for recording data, frames for items, lines and descriptive characters. The ink to be used for printing must be of drop-out color so as not to hamper reading of the record images, but when the slip is used for an optical reader having a reading wavelength range over the visible region, the kind and amount of ink to be used must be determined with full care. If otherwise, the print would affect reading. To avoid the cumbersome procedure, optical readers having reading wavelengths in the infrared region are in growing use, and a wide variety of such readers have been developed.

Accordingly, U.S. Pat. Nos. 4,020,056 and 4,107,428 propose use of a phthalide compound having two vinyl linkages as a chromogenic material suited to optical readers which utilize near infrared light. When this compound is used as a chromogenic material for heat sensitive record material, the chromogenic material is present in a close proximity with a color acceptor to react with a high reactive efficiency upon melting by heat and form a color having an excellent color density. However, when this compound is used for pressure sensitive manifold sheet, the phthalide compound or color acceptor has a low transfer efficiency and low reactive efficiency to form a record image of a low color density, whereby the record image is not legible or frequently misread by optical readers to provide manifold sheet having a poor practical use. Furthermore, the record image obtained by bringing the phthalide compound into contact with the color acceptor is low in lightfastness and appears thin or disappears when a line marker, cellophane tape or the like containing a considerable amount of plasticizer is used on the image. Thus, this phthalide compound is not usable for important documents.

On the other hand, a chelate-type record material comprising an iron (III) compound or a vanadium compound, and a ligand compound in combination therewith forms a record image which is superior in lightfastness and resistance to placticizers to that obtained from the above phthalide compound and color acceptor, but is inferior in color density. Accordingly, when such a chelate-type record material is used for pressure sensitive manifold sheet, the record image is not legible by optical readers having a reading wavelength over the infrared region to provide manifold sheet having no practical use.

An object of the invention is to provide a pressure sensitive manifold sheet which has excellent characteristics for use with optical readers having a reading wavelength range over the infrared region.

Another object of the invention is to provide a pressure sensitive manifold sheet which forms a record image outstanding in lightfastness and resistance to plasticizers.

The above and other objects of the invention will become apparent from the following description.

In a pressure sensitive manifold sheet comprising a substrate which is coated on one surface thereof with a coating composition containing (a) at least one of an iron (III) compound and a vanadium compound [(a) component] and a coating composition containing (b) an aromatic compound having at least one of hydroxyl group and mercapto group on the aromatic ring [(b) component] in the form of superposed layers or a layer of the mixture of these two coating compositions, or comprising substrates in which a layer of one of the coating compositions is formed on a surface of one substrate and a layer of the other coating composition is formed on a surface of another substrate, or comprising a substrate provided with a layer of one of the coating compositions and a layer of the other coating composition separately on the opposite surfaces thereof, and which forms a color when pressed, the present invention provides a pressure sensitive manifold sheet of a self-contained type or transfer type which is characterized in that at least one infrared absorbing organic compound selected from the group consisting of (c-1) component and (c-2) component below is contained in any one of the above layers of two coating compositions, or in another layer adjacent to one of the above layers.

(c-1): an organic compound having an absorption in the infrared region, (c-2): an electron donating chromogenic material which reacts with the above aromatic compound [(b) component] to form a color having an absorption in the infrared region.

We have found that when a chelate-type record material comprising an iron (III) compound and/or a vanadium compound, and a ligand compound combination therewith is used in combination with another infrared absorbing organic compound, not only effects of two components are obtained but also the chelate-type record material positively acts to improve the lightfastness derived from the infrared absorbing organic compound. Accordingly, pressure sensitive manifold sheet can be obtained which produces a color image outstanding in lightfastness and resistance to plasticizers and having a wide absorption wavelength range over the infrared region.

In the invention, examples of iron (III) compounds are a salt, composite salt or mixed salt of Fe(III) with at least one of 1 an organic phosphorus compound having a bond of P—OH and/or P—SH, 2 a carboxylic acid, thio-acid and dithioic acid and 3 an organic sulfur compound having a bond of S—OH. An iron (III) containing silioxane compound is also used such as polyferrophenylmethylsiloxane, etc.

Among the iron (III) compounds, preferable is an organic phosphorus-iron compound obtained by the reaction of iron (III) and the organic phosphorus compound and having a bond of P—O . . . $Fe^{3+}$ and/or P—S . . . $Fe^{3+}$ in the molecule, which has a pale color per se and exhibits excellent color forming properties. More preferable is an organic phosphorus-iron composite salt resulting from the reaction between iron (III) and at least one of the organic phosphorus compounds and at least one of the carboxylic acid, thio-acid, dithioic acid and organic sulfur compound having a bond of S—OH, which also has a pale color per se and exhibits an exellent initial color forming ability. Examples of the organic phosphorus compounds are those represented by the formulae (I) to (XVIII) below.

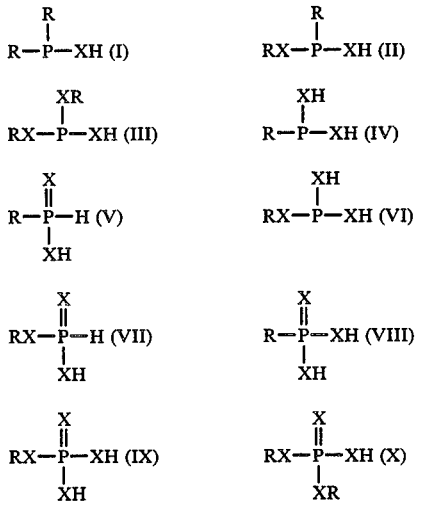

-continued

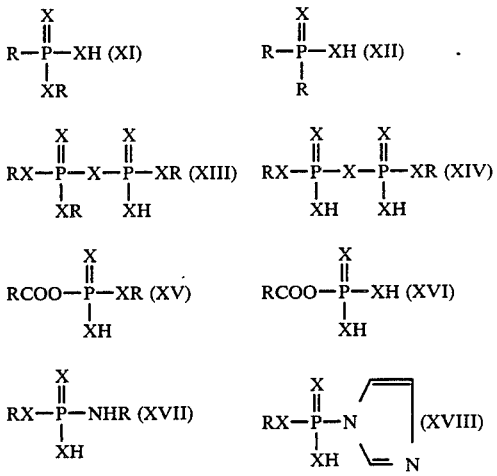

wherein X is the same or different and is oxygen atom or sulfur atom, R is the same or different and is alkyl group or aryl group.

The alkyl groups represented by R include a saturated or unsaturated alkyl group with or without a substituent which alkyl may be any of straight-chain or branched-chain alkyl and cycloalkyl groups. Preferred alkyl groups are those having 1 to 20 carbon atoms except the carbon atoms in the substituent. The aryl groups represented by R include those substituted or unsubstituted and are preferably those having 6 to 14 carbon atoms except the carbon atoms in the substituent. Exemplary of such aryl groups are phenyl, naphthyl, anthryl, etc.

The alkyl and/or aryl group(s) may form a 5-membered or 6-membered ring with phosphorus atom or with oxygen and/or sulfur atoms(s) between phosphorus atom and the groups. The aryl group may form a 5-membered or 6-membered ring between different positions in the same aromatic ring.

The carboxylic acid, thio-acid and dithioic acid useful in the invention are represented by the formula (XIX),

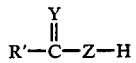

(XIX)

wherein R′ is alkyl or aryl, Y and Z are oxygen atom or sulfur atom. The alkyl and aryl groups represented by R′ include the same saturated or unsaturated, substituted or unsubstituted alkyl and substituted or unsubstituted aryl as in the above R of the organic phosphorus compounds.

The organic sulfur compounds having a bond of S—OH include a sulfonic acid, sulfinic acid and sulfate. Examples of useful organic sulfur compounds are benzenesulfonic acid, alkylbenzenesulfonic acid, naphthalene-sulfonic acid, alkylnaphthalenesulfonic acid, polystyrene-sulfonic acid, dialkylsulfosuccinic acid, alkylbenzenesulfinic acid, alkyl sulfate, etc.

Further, in order to change the tone of images, etc, it is possible to add a metal salt other than the organic iron (III) salt in the form of a composite salt or mixed salt with the iron (III) salt. Examples of the metal ions are $Ti^{4+}$, $Fe^{2+}$, $Co^{2+}$, $Ni^{2+}$, $Cu^{2+}$, etc.

The iron (III) compound can be prepared in a manner which is not particularly limited and, for example, prepared by a method disclosed in U.S. Pat. No. 4,533,930.

The vanadium compound useful in the invention includes an organic vanadium compound formed from a compound represented by the formulae [XX] to [XXII] and a compound represented by the formula [XXIII] or [XXIV].

$$MVO_3.nH_2O \quad [XX]$$

$$M_3VO_4.nH_2O \quad [XXI]$$

$$M_4V_2O_7.nH_2O \quad [XXII]$$

wherein M is an ammonium type cation group; alkali metal cation such as lithium, sodium, potassium, etc; alkaline earth metal cation such as beryllium, magnesium, calcium, strontium, barium, etc, n is an integer of 0 to 16,

[XXIII]

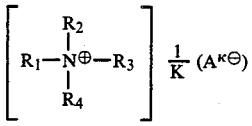

[XXIV]

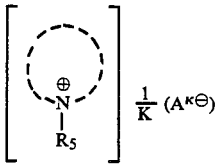

wherein $R_1$ is alkyl group having 6 to 21 carbon atoms, $R_2$, $R_3$, $R_4$ are each hydrogen atom or alkyl group having 1 to 21 carbon atoms, $R_5$ is hydrogen atom or alkyl group having 1 to 21 carbon atoms,

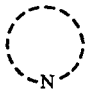

is pyridinium ring, quinolinium ring or a substituted ring of these rings with alkyl group having 1 to 12 carbon atoms, phenyl, tolyl, benzyl, phenethyl, etc. $A^{k\ominus}$ is chlorine, bromine, iodine, anion derived from nitric acid, acetic acid, propionic acid, benzoic acid or like monobasic acid and sulfuric acid, phthalic acid, oxalic acid or like dibasic acid, k is 1 or 2 and k is 1 when A is monobasic acid and k is 2 when A is dibasic acid.

Further, the vanadium compound includes a matallosiloxane compound having a bond of silicone-oxygen-metal and represented by the formula [XXV], etc

[XXV]

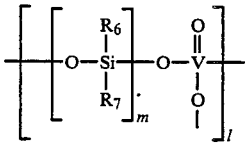

wherein $R_6$, $R_7$ are each hydroxyl group, alkyl group having 1 to 12 carbon atoms, phenyl, tolyl, benzyl, phenethyl, etc, and l and m are each positive integer.

As the ligand compound which reacts with the iron (III) compound and/or vanadium compound to form a complex exhibiting a color image is used an aromatic compound having at least one of hydroxyl group and mercapto group on the aromatic ring [(b) component].

Examples of such compounds are toluene-3,4-dithiol, laurybenzene-3,4-dithiol, salicylic acid, 3,5-di(α-methylbenzyl)salicylic acid, hydroxynaphthoic acid, 2-hydroxy-1-naphthoaldehyde, resorcin, t-butylcatechol, dihydroxybenzenesulfonic acid, gallic acid, ethyl gallate, propyl gallate, isoamyl gallate, octyl gallate, lauryl gallate, benzyl gallate, tannic acid, pyrogallol tannin, protocatechuic acid, ethyl protocatechuate, pyrogallol-4-carboxylic acid, 8-hydroxyquinoline, dichloro-8-hydroxyquinoline, dibromo-8-hydroxyquinoline, chlorobromo-8-hydroxyquninoline, methyl-8-hydroxyquinoline, butyl-8-hydroxyquinoline, lauryl-8-hydroxyquinoline, methylenebis(8-hydroxyquinoline), zinc salicylate, zinc 3,5-di(α-methylbenzyl)salicylate, phenolic resin, etc.

Especially preferable of (b) components are those having at least two groups selected from hydroxyl group and mercapto group in adjacent positions on the aromatic ring such as gallic acid, ethyl gallate, propyl gallate, isoamyl gallate, octyl gallate, lauryl gallate, benzyl gallate, tannic acid, protocatechuic acid, ethyl protocatechuate, toluene-3,4-dithiol, laurylbenzene-3,4-dithiol, etc., because these compounds react with the iron (III) compound or vanadium compound to form a color having a relatively strong absorption in the infrared region.

When the iron (III) compound or the vanadium compound is used with an ion other than $Fe^{3+}$ or V, it is possible to use a ligand compound which accords with the ion, for example, N,N'-dibenzyl dithioxamide for $Ni^{2+}$, 1,10-phenanthroline for $Fe^{2+}$.

The pressure sensitive manifold sheet of the present invention for use with optical readers has the important feature that the above-mentioned chelate-type record material is used in combination with an infrared absorbing organic compound. Useful infrared absorbing organic compounds are various compounds having a molecular extinction coefficient of at least 1000 in the range of from 700 to 900 nm.

Examples of the infrared absorbing organic compounds are the following (c-1) component and (c-2) component.

(c-1): an organic compound having an absorption in the infrared region, (c-2): an electron donating chromogenic material which reacts with the (b) component to form a color having an absorption in the infrared region.

Examples of useful (c-1) components are compounds represented by the formulae [XXVI], [XXVII] and [XXVIII], etc.

Examples of preferred (c-2) components are a phthalide compound of the formula [XXIX], fluorene phthalide compound of the formula [XXX], etc.

[XXVI]

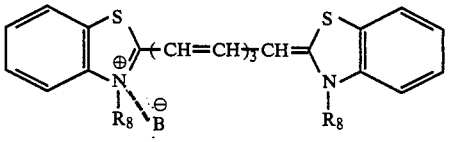

wherein B is a halogen atom, $R_8$ is methyl or ethyl.

[XXVII]

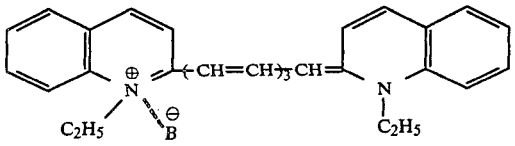

wherein B is a halogen atom.

[XXVIII]

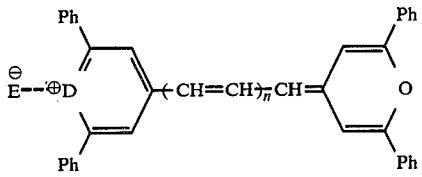

wherein n is 1 or 2, D is S, Se or Te, E is $ClO_4$ or $BF_4$.

[XXIX]

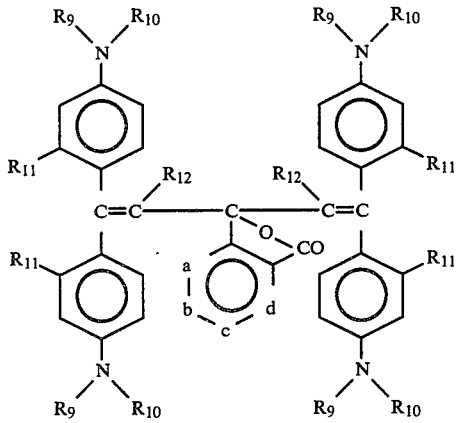

wherein $R_9$ and $R_{10}$ are each an alkyl group, alicyclic group, aryl group or aralkyl group which is unsubstituted or substituted with a halogen atom, alkyl group or alkoxyl group, $R_9$ and $R_{10}$ may form a hetero ring when taken together or together with the benzene ring adjacent thereto, $R_{11}$ is a hydrogen atom, halogen atom, alkyl group, alkoxyl group or acyloxy group, $R_{12}$ is a hydrogen atom or alkyl group, a, b, c and d are each a carbon atom, one or two of the carbon atoms a to d may be a nitrogen atom, each of the carbon atoms a to d may have a hydrogen atom, halogen atom, alkyl group, alkoxyl group, dialkylamino group or nitro group attached thereto as a substituent, and the a-b, b-c or c-d linkage may form another aromatic ring.

[XXX]

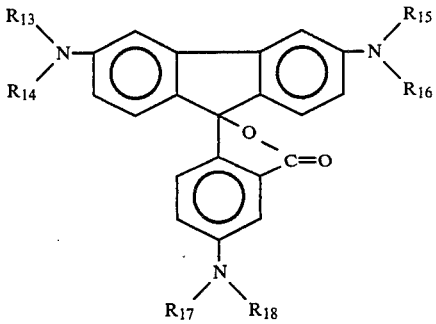

wherein $R_{13}$, $R_{14}$, $R_{15}$, $R_{16}$, $R_{17}$ and $R_{18}$ are each an alkyl group having 1 to 4 carbon atoms.

Of these infrared absorbing organic compounds, those represented by the formula [XXIX] or [XXX] are most preferable to use, because these compounds are electron donating chromogenic material which react with (b) component to form a color image capable of absorbing light in the infrared region of from 700 to 900 nm, so that the image is highly contrasty and hardly misread by optical readers.

The phthalide components of the formula [XXIX] include 3,3-bis[1,1-bis(4-dimethylaminophenyl)ethylene-2-yl]-4,5,6,7-tetrachlorophthalide, 3,3-bis[1,1-bis(4-dimethylaminophenyl)ethylene-2-yl]-5,6-dichloro-4,7-dibromophthalide, 3,3-bis[1,1-bis(4-dimethylaminophenyl)ethylene-2-yl]-4,7-dichloro-5,6-dibromophthalide, 3,3-bis[1,1-bis(4-diethylaminophenyl)ethylene-2-yl]-4,5,6,7-tetrachlorophthalide, 3,3-bis[1,1-bis(2-methyl-4-diethylaminophenyl)ethylene-2-yl]-4,5,6,7-tetrachlorophthalide, 3,3-bis[1,1-bis(2-methoxy-4-diethylaminophenyl)ethylene-2-yl]-4,5,6,7-tetrachlorophthalide, 3,3-bis[1,1-bis(4-dimethylaminophenyl-1-propene-2-yl]-4,5,6,7-tetrachlorophthalide, 3,3-bis[1,1-bis(4-dimethylaminophenyl)ethylene-2-yl]-5-pyrrolidinophthalide, 3,3-bis[1,1-bis(4-dimethylaminophenyl)ethylene-2-yl]-6-pyrrolidinophthalide, 3,3-bis[1,1-bis(4-dimethylaminophenyl)ethylene-2-yl]-5,6-dichlorophthalide, 3,3-bis[1,1-bis(4-dimethylaminophenyl)ethylene-2-yl]phthalide, 3,3-bis[1,1-bis(4-dimethylaminophenyl)ethylene-2-yl]-5-dimethylaminophthalide, 3,3-bis[1,1-bis(4-dimethylaminophenyl)ethylene-2-yl]-6-dimethylaminophthalide, 3,3-bis[1,1-bis(4-dimethylaminophenyl)ethylene-2-yl]-5-nitrophthalide, 3,3-bis[1,1-bis(4-dimethylaminophenyl)ethylene-2-yl]-6-nitrophthalide, 3,3-bis[1,1-bis(4-diethylaminophenyl)ethylene-2-yl]-5-ethoxyphthalide, 3,3-bis[1,1-bis(4-diethylaminophenyl)ethylene-2-yl]-6-ethoxyphthalide, 3,3-bis[1,1-bis(4-dimethylaminophenyl)ethylene-2-yl]-5-methylphthalide, 3,3-bis[1,1-bis(4-dimethylaminophenyl)ethylene-2-yl]-6-methylphthalide, 3,3-bis[1,1-bis(4-N-ethyl-N-benzylaminophenyl)ethylene-2-yl]-4,5,6,7-tetrachlorophthalide, 3,3-bis[1,1-bis(4-N-methyl-N-p-tolylaminophenyl)ethylene-2-yl]-4,5,6,7-tetrachlorophthalide, 3,3-bis[1,1-bis(4-dimethylaminophenyl)ethylene-2-yl]-5,6-benzophthalide, 3,3-bis[1,1-bis(4-dimethylaminophenyl)ethylene-2-yl]-4-azaphthalide, 3,3-bis[1,1-bis(4-dimethylaminohenyl)ethylene-2-yl]-5-azaphthalide, 3,3-bis[1,1-bis(4-dimethylaminophenyl-)ethylene-2-yl]-6-azaphthalide, 3,3-bis[1,1-bis(4-dimethylaminophenyl)ethylene-2-yl]-7-azaphthalide, 3,3-bis[1,1-bis(4-dimethylaminophenyl)ethylene-2-yl]-4,7-diazaphthalide, 3,3-bis[1,1-bis(4-dimethylaminophenyl-)ethylene-2-yl]-5,6-benzo-4,7-diazaphthalide, 3,3-bis[1,1-bis(4-pyrrolidinophenyl)ethylene-2-yl]phthalide, 3,3-bis[1,1-bis(4-pyrrolidinophenyl)ethylene-2-yl]-4,5,6,7-tetrachlorophthalide, 3,3-bis[1,1-bis(4-pyrrolidinophenyl)ethylene-2-yl]-5,6-dichloro-4,7-dibromophthalide, 3,3-bis[1,1-bis(4-pyrrolidinophenyl-)ethylene-2-yl]-4,7-dichloro-5,6-dibromophthalide, 3,3-bis[1,1-bis(4-pyrrolidinophenyl)ethylene-2-yl]-5-chloro-4,6,7-tribromophthalide, 3,3-bis[1,1-bis(4-pyrrolidinophenyl)ethylene-2-yl]-6-chloro-4,5,7-tribromophthalide, 3,3-bis[1,1-bis(4-pyrrolidinophenyl)ethylene-2-yl]-5-nitrophthalide, 3,3-bis[1,1-bis(4-pyrrolidinophenyl-)ethylene-2-yl]-6-nitrophthalide, 3,3-bis[1,1-bis(4-pyrrolidinophenyl)ethylene-2-yl]-5-ethoxyphthalide, 3,3-bis[1,1-bis(4-pyrrolidinophenyl)ethylene-2-yl]-6-ethoxyphthalide, 3,3-bis[1,1-bis(4-pyrrolidinophenyl)ethylene-2-yl]-5-methylphthalide, 3,3-bis[1,1-bis(4-pyrrolidinophenyl)ethylene-2-yl]-6-methylphthalide, 3,3-bis[1,1-bis(4-pyrrolidinophenyl)ethylene-2-yl]-5-pyrrolidinophthalide, 3,3-bis[1,1-bis(4-pyrrolidinophenyl-)ethylene-2-yl]-6-pyrrolidinophthalide, 3,3-bis[1,1-bis(4-pyrrolidinophenyl)ethylene-2-yl]-5,6-dichlorophthalide, 3,3-bis[1,1-bis(4-piperidinophenyl)ethylene-2-yl]phthalide, 3,3-bis[1,1-bis(4-piperidinophenyl)ethylene-2-yl]-5-dimethylaminophthalide, 3,3-bis[1,1-bis(4-piperidinophenyl)ethylene-2-yl]-6-dimethylaminophthalide, 3,3-bis[1,1-bis(4-piperidinophenyl)ethylene-2-yl]-4,5,6,7-tetrachlorophthalide, 3,3-bis[1,1-bis(4-morpholinophenyl)ethylene-2-yl]-4,5,6,7-tetrachlorophthalide, 3,3-bis[1,1-bis(4-hexamethyleneiminophenyl)ethylene-2-yl]-4,5,6,7-tetrachlorophthalide, 3,3-bis[1,1-bis(2-methyl-4-pyrrolidinophenyl)ethylene-2-yl]-4,5,6,7-tetrachlorophthalide, 3,3-bis[1,1-bis(2-methoxy-4-pyrrolidinophenyl)ethylene-2-yl]-4,5,6,7-tetrachlorophthalide, 3,3-bis[1,1-bis(4-pyrrolidinophenyl)-1-propene-2-yl]4,5,6,7-tetrachlorophthalide, 3,3-bis[1,1-bis(1-methyl-1,2,3,4-tetrahydroquinoline-4-yl)ethylene-2-yl]-4,5,6,7-tetrachlorophthalide, 3,3-bis[1,1-bis(julolidine-5-yl)ethylene-2-yl]-4,5,6,7-tetrachlorophthalide, etc.

Examples of the fluorene phthalide compounds of the formula [XXX] are 3,6,6′-trisdimethylamino-spiro(fluorene-9,3′-phthalide), 3-diethylamino-6,6′-bisdimethylamino-spiro(fluorene-9,3′-phthalide), 3,6-bisdiethylamino-6′-dimethylamino-spiro(fluorene-9,3′-phthalide), 3,6-bisdimethylamino-6′-diethylamino-spiro(fluorene-9,3′-phthalide), 3,6′-bisdiethylamino-6-dimethylamino-spiro(fluorene-9,3′-phthalide), 3,6,6′-trisdiethylamino-spiro(fluorene-9,3′-phthalide), 3-di-n-butylamino-6,6′-bisdimethylamino-spiro(fluorene-9,3′-phthalide), 6′-di-n-butylamino-3,6-bisdimethylamino-spiro(fluorene-9,3′-phthalide), 3-di-n-propylamino-6,6′-bisdimethylamino-spiro(fluorene-9,3′-phthalide), 6-di-n-propylamino-3,6-bisdimethylamino-spiro(fluorene-9,3′-phthalide), 3,6,6′-trisdi-n-propylamino-spiro(fluorene-9,3′-phthalide), 3-di-n-butylamino-6-diethylamino-6′-dimethylamino-spiro(fluorene-9,3′-phthalide), 3,6′-bisdiethylamino-6-di-n-butylamino-spiro(fluorene-9,3′-phthalide), 3-di-n-butylamino-6-dimethylamino-6′-diethylamino-spiro(fluorene-9,3′-phthalide), 3-diethylamino-6-dimethylamino-6′-di-n-butylamino-spiro(-fluorene-9,3′-phthalide), etc.

In pressure sensitive manifold sheet of the invention, (a), (b) components and the infrared absorbing organic compound [(c-1) or (c-2) component] are used in such an amount to form a color image which is legible by optical reader, although depending on the kinds of the materials used, contemplated sheets and optical readers, etc. It is, however, preferable to coat (a) component, (b) component and (c-1) or (c-2) component in amounts of at least 0.2 millimole, at least 0.3 millimole and at least 0.01 millimole respectively per one square meter of the substrate. These three components are employed more preferably in amounts of at least 1 millimole, at least 1 millimole and at least 0.03 millimole respectively per one square meter of the substrate, thereby pressure sensitive manifold sheet is obtained that produces a color image which is not misread by optical reader having a reading wavelength range over the infrared region. These three compounds are preferably used in amounts of up to 35 millimoles, up to 30 millimoles and up to 10 millimoles respectively per one square meter of the substrate from the viewpoint of economy and prevention of coloring in the background of the sheet.

In the invention, when desired, it is possible to further use an electron donating chromogenic material which is known in the art of pressure sensitive manifold sheet and form a color image having an absorption in visible region.

In the invention, the above record materials are generally made into a coating composition, with or without microencapsulation which is coated on a substrate to form pressure sensitive manifold sheet.

In microencapsulation of the above recording material, it is possible to encapsulate the material as it is when the material is liquid. However, the material is generally microencapsulated as dispersed or dissolved in a hydrophobic medium.

Any of various hydrophobic media can be used as desired which is already known in the field of pressure sensitive manifold sheet.

Examples thereof are cotton seed oil and like vegetable oils; kerosene, paraffin, naphthene oil, chlorinated paraffin and like mineral oils; alkylated biphenyl, alkylated terphenyl, alkylated naphthalene, diarylethane, triarylmethane, diphenylalkane and like aromatic hydrocarbons; octyl alcohol, oleyl alcohol, tridecyl alcohol, benzyl alcohol, 1-phenylethyl alcohol, glycerin, benzylcellosolve, n-butylcellosolve, phenylcellosolve, isopropylcellosolve and like alcohols; dimethyl phthalate, diethyl phthalate, di-n-butylphthalate, dioctyl phthalate, dimethyl terephthalate, diethyl adipate, dipropyl adipate, di-n-butyl adipate, dioctyl adipate, diethyl maleate, di-n-butyl maleate, dioctyl maleate, di-n-butyl fumarate, dimethyl sebacate, diethyl sebacate, di-n-butyl sebacate, diethyl succinate, di-n-butyl succinate and like esters; phenyl phosphate, tricresyl phosphate, tributyl phosphate, tributyl phosphite, tributyl phosphine oxide and like organic phosphorus compounds; diethyl carbitol, di-n-butyl carbitol, dibenzyl ether, diphenyl ether, di-n-hexyl ether, n-butyl glycidyl ether and like ethers; diisobutyl ketone, methyl hexyl ketone, dibenzyl ketone, diphenyl ketone and like ketones; N,N-dimethyllauramide, N,N-dimethylstearamide, N,N-dihexyloctylamide, succinamide, acetanilide and like acid amides; ethylene carbonate, propylene carbonate and like carbonates; decyl mercaptan, lauryl mercaptan, cetyl mercaptan and like thiols; dioctyl sulfide, didecyl sulfide, diphenyl sulfide, dibenzyl sulfide and like sulfides; didodecyl disulfide, diphenyl disulfide, dibenzyl disulfide and like disulfides; aliphatic amine, aromatic amine, alicyclic amine, amidine, guanidine, nitrogen-containing heterocyclic compound, heterocyclic amine, and like organic bases; etc. Examples of useful organic bases are tripropylamine, tri(n-octyl)amine, tribenzylamine, N,N-dibenzyl-$\beta$-aminoethanol, N-methyldibenzylamine, N-ethyldibenzylamine, N-i-propyldibenzylamine, N-n-propyldibenzylamine, N-n-butyldibenzylamine, N-t-butyldibenzylamine, N-diethylbenzylamine, N-di-n-propylbenzylamine, N-di-i-propylbenzylamine, N-di-n-butylbenzylamine, N-di-t-butylbenzylamine, N-di-n-hexylbenzylamine, N-di-n-octylbenzylamine, di(2-ethylhexyl)amine, didodecylamine, dioctadecylamine, dibenzylamine, dodecylamine, hexadecylamine, octadecylamine, N-dibutylphenylamine, N-diethyl-p-tolylamine, N-dibenzylphenylamine, N-ethyl-N-benzylphenylamine, N-diphenylmethylamine, N-dodecylphenylamine, diphenylamine, N-naphthylphenylamine, N-(p-octylphenyl)phenylamine, mesidine, dicyclohexylamine, N,N'-diphenylformamidine, 1,3-diphenylguanidine, 1,1,3,3-tetraphenylguanidine, pyridine, quinoline, morpholine, 1,2,3,4-tetrahydroquinoline, amines of the formulae

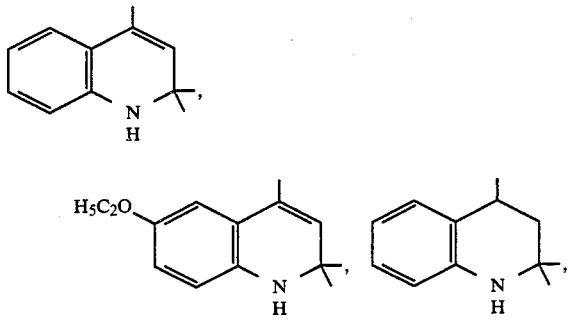

In microencapsulation of record materials of the invention, it is preferable to use, among the above hydrophobic media, alcohols, esters, organic phosphorus compounds, ethers, ketones, acid amides, carbonates, thiols, sulfides, disulfides or organic bases in an amount of 10 to 100% by weight based on the whole hydrophobic medium, thereby pressure sensitive manifold sheet is obtained which is hardly misread.

When the hydrophobic medium is solid, it is preferably used in the form of a liquid by being admixed with other compound(s).

The encapsulation, which is not particularly limited, can be conducted by any of known processes such as coacervation process, interfacial polymerization process, in-situ polymerization process, etc. However, preferable is a method in which a wall film is made of a synthetic resin in order to obtain a more excellent pressure sensitive manifold sheet. Among these conventional processes, preferable are those disclosed in Japanese Examined Patent Publication No. 16949/1979 and Japanese Unexamined Patent Publication No. 84881/1978 in which urea formaldehyde resin and melamine formaldehyde resin are used as the wall-forming material, whereby capsules having extremely excellent properties are obtained.

Further to these microencapsules are added as desired an antioxidant, ultraviolet ray absorbing agent, etc. The microcapsules thus obtained are used singly or in mixture, and further mixed, when desired, with auxiliaries usually used in the art to which this invention pertains, whereby a capsule coating composition is prepared. Typical of useful auxiliaries are water-soluble or latex type binder, capsule-protecting agent, dispersing agent, antifoaming agent, antiseptic, fluorescent dye, colored dye, white pigment, desensitizer, etc. Useful water-soluble binders include natural high molecular weight compounds such as gelatin, albumin, casein and like proteins, corn starch, α-starch, oxidized starch, etherified starch, esterified starch and like starches, carboxymethyl cellulose, hydroxyethyl cellulose and like celluloses, agar, sodium alginate, gum arabic and like saccharoses, synthetic high molecular weight comounds such as polyvinyl alcohol, polyvinyl pyrrolidone, polyacrylic acid, polyacrylamide, maleic acid copolymer, etc. Examples of useful latex binders are styrene-butadiene latex, acrylonitrile-butadiene latex, acrylic ester latex, vinyl acetate latex, methyl methacrylate-butadiene latex and carboxy-modified (e.g. acrylic acid) latex thereof, etc.

Examples of useful capsule-protecting agents are cellulose powder, starch granules, talc, calcined kaolin, calcium carbonate, etc.

The recording material, when not encapsulated, is pulverized as required by a ball mill, attritor, sand mill, etc. and mixed with auxiliaries usually used such as white pigment, binder, dispersing agent, colored dye, fluorescent dye, ultraviolet ray absorbing agent, antioxidant, defoaming agent, organic base, etc. to prepare a coating composition. When desired, it is possible to add the above microcapsules.

Dispersing agents include low molecular weight and high molecular weight dispersing agents and surfactants. Examples thereof are sodium alkylsulfate, sodium alkylbenzenesulfonate, sodium alkylnaphthalenesulfonate, sodium polystyrenesulfonate, sodium oleic acid amide sulfonate, sodium dialkylsulfosuccinate, sulfonated castor oil and like anionic surfactants, trimethylaminoethylalkylamide halide, alkyl pyridinium sulfate, alkyl trimethyl ammonium halide and like cationic surfactants, polyoxyethylenealkyl ether, polyoxyethylene fatty acid ester, polyoxyethylenealkyl phenyl ether, polyhydric alcohol ester of fatty acid, polyoxyethylene polyhydric alcohol ester of fatty acid, cane sugar ester of fatty acid and like nonionic surfactants, alkyl trimethylaminoacetic acid, alkyl diethylenetriaminoacetic acid and like amphoteric surfactants, starch, phosphated starch, polyvinyl alcohol, carboxymethyl cellulose, sodium alginate, sodium polyacrylate, sodium salt of vinyl acetate-maleic anhydride copolymer, ammonium salt of styrene-maleic anhydride copolymer, sodium salt of butadiene-methacrylate copolymer and like water-soluble high molecular weight compounds, etc.

Examples of useful white pigments are oxide, hydroxide, carbonate, sulfate, phosphate, silicate and halogenated compounds of aluminum, zinc, magnesium, calcium and titanium, and silica, terra abla, activated clay, attapulgite, zeolite, bentonite, kaolin, calcined kaolin, talc and like clays, pigments such as those disclosd in Japanese Unexamined Patent Publication No. 103994/1980, etc.

In the invention, (c-1) or (c-2) component is, when encapsulated or not encapsulated, contained in a coating composition preferably in the form of a solution or a mixture with at least one of the above hydrophobic medium selected from the group consisting of vegetable oils, mineral oils, aromatic hydrocarbons, alcohols, esters, organic phosphorus compounds, ethers, ketones, acid amides, carbonates, thiols, sulfides, disulfides and organic bases at room temperature or with heating. In this case, pressure sensitive manifold sheet is obtained which produces a color image having a strong absorption in the infrared region. It is desirable to dissolve or melt 1 to 100 parts by weight, preferably 3 to 50 parts by weight of (c-1) or (c-2) component per 100 parts by weight of the hydrophobic medium. Among these hydrophobic media, preferable are alcohols, esters, organic phosphorus compounds, ethers, ketones, acid amides, carbonates, thiols, sulfides, disulfides and organic bases which have an excellent solubility with (c-1) or (c-2) component. Particularly preferable is organic base which enhances absorption strength of the color image and provides pressure sensitive manifold sheet which is hardly misread. These preferred compounds are desirably used in an amount of 10 to 100% by weight, preferably 30 to 100% by weight based on the whole hydrophobic medium.

Further, when the hydrophobic medium with dissolved (c-1) or (c-2) component therein is microencapsulated to prepare a coating composition, pressure sensitive manifold sheet is obtained which is hardly misread. In the above, in case the organic base is used as a hydrophobic medium, pressure sensitive manifold sheet is obtained which is in no way misread.

These effects obtained by use of (c-1) or (c-2) component in the above manner, are most remarkably attained when an electron donating chromogenic material, namely (c-2) component is used as the infrared absorbing organic compound.

The infrared absorbing organic compound and the hydrophobic medium, when not encapsulated, are emulsified in an aqueous medium in case they are in the form of a solution, or finely pulverized in case they are in a molten mixture, as required, by a sand mill, etc.

The coating composition thus prepared is applied, as singly or in mixture,.by.an air knife coater, roll coater, blade coater, size press coater, curtain coater, bill blade coater, short dwell coater or the like to a suitable substrate such as paper, synthetic fiber paper, synthetic resin film or the like. The application may be carried out by printing on the substrate aqueous or solvent type flexographic ink, letterpress ink, lithographic ink, UV curable ink, EB curable ink or the like. Further, the coating composition can be applied to the paper material by impregnation.

The present invention provides various types of pressure sensitive manifold sheet which are known in the art.

Examples thereof are transfer type pressure sensitive manifold sheet comprising a top sheet, under sheet and, as required, middle sheet, and self-contained type pressure sensitive manifold sheet.

Further, each of (a), (b) and (c-1) or (c-2) components is coated in various manner in the present pressure sensitive manifold sheet. Preferable are transfer type pressure sensitive manifold sheet which comprises an oil transfer sheet (top sheet) coated with a coating composition of microcapsule containing (b) component, an oil accepting sheet (under sheet) coated with a coating composition containing (a) component and (c-2) component, and when required a sheet (middle sheet) coated with a coating composition containing (a) component and (c-2) component and a coating composition of microcapsule containing (b) component separately on the opposite surfaces thereof; self-contained type pressure sensitive manifold sheet coated with a coating composition of microcapsule containing (b) component and a coating composition containing (a) component and (c-2) component in the form of superposed layers; those of self-contained type coated with a coating composition containing (a) component and a coating composition of (c-2) component and microcapsule containing (b) component in the form of superposed layers or a layer of the mixture of these two coating compositions; etc. These sheets are preferable because the background thereof colors in the least with a lapse of time and those provided with microcapsule containing (c-2) component are most preferable since they are in no way misread.

While the infrared absorbing organic compound is contained in any one of the layers of two coating compositions in the above, the compound can be contained in another layer adjacent to one of the above layers. In this case, another layer means that formed on or under the layer of the coating composition. Namely, a coating composition containing the infrared absorbing organic compound can be coated on or under the layer of the coating composition containing at least one of (a) component and (b) component.

Preferable of these type are transfer type pressure sensitive manifold sheet which comprises a top sheet coated with a coating composition of microcapsule containing (b) component, an under sheet coated with a coating composition containing (a) component and a coating composition containing (c-2) component in the form of superposed layers, and when required a middle sheet coated on one surface thereof with a coating composition containing (a) component and a coating composition containing (c-2) component in the form of superposed layers, and coated on the opposite surface thereof with a coating composition of microcapsule containing (b) component; self-contained type pressure sensitive manifold sheet coated with a coating composition of (a) component and microcapsule containing (b) component and a coating composition containing (c-2) component in the form of superposed layers; etc. These sheets are preferable because the background thereof colors in the least with a lapse of time and those provided with microcapsule containing (c-2) component are most preferable since they are in no way misread.

The present pressure sensitive manifold sheet can be used in the form of a set in combination with an other manifold layer. As recording materials forming the above other manifold layer are used those which produce a color image having an excellent resistance to plasticizers, such as chelate-type record material comprising the above combination of the iron (III) compound and/or vanadium compound and a ligand compound; chelate-type record material comprising a combination of a metal compound other than Fe and V and a ligand compound; leuco-type record material comprising a combination of diarylmethane derivative of the formula [XXXI] below and a color acceptor; etc.

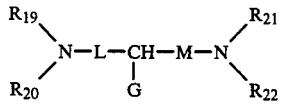

[XXXI]

wherein L and M are each 1,4-arylene group or substituted 1,4-arylene group. Examples of 1,4-arylene groups are 1,4-phenylene, 1,4-naphthylene, etc. and examples of substituents for 1,4-arylene group are a halogen atom, alkyl group, alkoxyl group, cyano group, substituted amino groups, nitro groups, etc. G is a group of —O—Q, —N(S)(T) or —$SO_2$—$R_{23}$, Q, S and T being each hydrogen atom or a substituted or unsubstituted hydrocarbon group with or without at least one hetero atom.

Preferred examples of Q, S and T are hydrogen atom; alkyl group; alkyl group substituted with a halogen atom, alkoxyl group, cyano group or substituted amino group; aralkyl group; aralkyl group substituted with a halogen atom, alkyl group, alkoxyl group, aralkyl group, aryl group, cyano group, substituted amino group or nitro group; aryl group; aryl group substituted with a halogen atom, alkyl group, alkoxyl group, aralkyl group, aryl group, cyano group, substituted amino group or nitro group. S and T may form a hetero ring, preferably 5-membered or 6-membered hetero ring when taken together.

$R_{19}$ to $R_{23}$ are each alkyl group, substituted alkyl group, cycloalkyl group, substituted cycloalkyl group, aralkyl group, substituted aralkyl group, aryl group or substituted aryl group. Preferable examples thereof are alkyl group; alkyl group substituted with a halogen atom, alkoxy group or cyano group; aralkyl group; aralkyl group substituted with a halogen atom, alkyl group, alkoxyl group, aralkyl group, aryl group, cyano group, substituted amino group or nitro group; aryl group; aryl group substituted with a halogen atom, alkyl group, alkoxyl group, aralkyl group, aryl group, cyano group, substituted amino group or nitro group.

$R_{19}$ and $R_{20}$, and $R_{21}$ and $R_{22}$ may each form a hetero ring, preferably saturated 5-membered or 6-membered hetero ring when taken together.

Examples of useful diarylmethane derivatives of the formula [XXXI] are 4,4'-bis-dimethylamino-benzhydrol, 4,4'-bis-dibenzylamino-benzhydrol, 4,4'-bis-dimethylamino-2,2'-dichloro-benzhydrol, 4,4'-bis-dimethylamino-2,2'-dimethoxy-benzhydrol, 4,4'-bis-dimethylamino-2-acetamino-benzhydrol, 4,4'-bis-dimethylamino-3-nitrobenzhydrol, 4,4'-bis-di(cyanoethyl-)amino-benzhydrol, 4,4'-bis-(N-methyl-N-o-chlorobenzyl)amino-benzhydrol, 4,4'-bis-dimethylamino-benzhydryl-methyl ether, 4,4'-bis-dimethylamino-benzhydryl-phenyl ether, 4,4'-bis-dimethylamino-benzhydryl-pyridyl ether, bis-(4,4'-bis-diemthylamino-benzhydryl)ether, bis-(4-piperidinophenyl)carbinol methyl ether, 4,4'-bis-(N-methyl-N-chloroethyl)aminobenzhydryl benzyl ether, 4,4'-bis-dimethylamino-benzhydrylamine, N-phenyl-leucoauramine, N-(2,4-dimethylphenyl)-leucoauramine, N-(3-dimethylamino-4-methylphenyl)-leucoauramine, [diphenylene-(4,4')-]-dileucoauramine, morpholino-leucoauramine, piperidino-leucoauramine, (N-butyl-N-2,5-dichlorophenyl)-leucoauramine, N-bis-(4-dimethylaminophenyl)methylglycine ethyl ester, 4,4'-bis-dimethylamino-benzhydrol-p-toleuensulfinate, 4,4'-bis-dimethylamino-benzhydrol-benzylsulfinate, 4,4'-bis-dimethylamino-benzhydrol-p-chlorobenzenesulfinate, 4,4'-bis-dimethylamino-benzhydrol-p-methoxybenzenesulfinate, etc.

As the color acceptors, any of known materials in the art can be used such as activated clay, phenolic resin, polyvalent metal salt of aromatic carboxylic acid, etc.

In the above, any of combination of a metal compound other than Fe and V and a ligand compound is usable which is known in the field of record materials. Examples of useful combinations are N,N'-dibenzyl-dithio-oxamide and nickel stearate; α-benzyl glyoxime and nickel laurate; lauryl protocatechuate and benzyl lauryl dimethyl ammonium molybdate, lauryl gallate and titanium stearate; N,N'-bis-2-octanoyloxyethyl diethyldithiooxamide and copper palmitate; di-o-tolyl guanidine and cobalt laurate; etc.

This invention will be described below in more detail with reference to Examples and Comparison Examples by no means limited to, in which parts and percentages are all by weight, unless otherwise specified.

In Examples and Comparison Examples, pressure sensitive manifold sheet was checked for optical readability in terms of PCS (Print Contrast Signal) value which was calculated by the following equation.

$$PCS \text{ value} = \frac{A - B}{A}$$

A: reflectivity of the background area

B: reflectivity of the recorded (colored) area

Larger the value is, smaller the possibility of being misread. Pressure sensitive manifold sheet having PCS value less than 0.5 is not legible by optical readers.

EXAMPLE 1

Preparation of a microcapsule dispersion containing a ligand compound and a top sheet A 30 part quantity of lauryl gallate and 6 parts of N,N-dibenzyl-β-aminoethanol were dissolved with heating in a mixture of 32 parts of diethyl adipate and 32 parts of di-n-butyl adipate to obtain an inner-phase oil. A 20% aqueous solution of sodium hydroxide was added to 200 parts of 3.0% aqueous solution of ethylene-maleic anhydride copolymer (trade name "EMA-31", product of Monsanto Co., Ltd.) to prepare an aqueous solution having a pH of 6.0. To the solution was added the inner-phase oil and the mixture was emulsified to obtain a dispersion of particles 5μ in average size and the resulting dispersion was heated to 55° C.

A 10 part quantity of melamine was added to 30 parts of 37% aqueous solution of formaldehyde and the mixture was reacted at 60° C. for 15 minutes to prepare an aqueous solution of a prepolymer.

The prepolymer solution was added dropwise to the above dispersion with stirring. To the dispersion was added dropwise 0.5N-HCl to adjust a pH to 4.8, thereafter the system was heated to 70° C. with stirring and maintained at the same temperature for 3 hours. Then, the mixture was allowed to cool to obtain a milk-white microcapsule dispersion containing a ligand compound.

A 20 part quantity of wheat starch powder and 10 parts of pulp powder were added to the dispersion. Water was added thereto in such amount as to achieve 18% solids concentration, whereby a capsule-containing coating composition was obtained. The coating composition was applied by an air-knife coater to a paper substrate weighing 40 g/m$^2$ in an amount of 10 g/m$^2$ by dry weight to prepare a top sheet. The coated layer of the top sheet contained about 5.7 millimoles/m$^2$ of ligand compound (lauryl gallate).

Preparation of a coating composition containing an iron (III) compound and infrared absorbing organic compound, and an under sheet (A) Preparation of an iron (III) compound slurry To 2000 parts of 2% aqueous solution of sodium hydroxide were added 71.2 parts of p-tert-butylbenzoic acid, 100 parts of diphenyl phosphate, 40.2 parts of di-o-biphenylyl phosphate and 34.8 parts of sodium laurylbenzenesulfonate. The solution was adjusted to pH of 8.0 with addition of 1N-HCl. An aqueous solution of 43.5 parts of ferric chloride in 1000 parts of water was added to the solution with stirring. Thereto were added 4.8 parts of $TiCl_4$ and 100 parts of 1N-HCl to obtain a dispersion which was filtered and washed to prepare a slurry of an organic phosphorus-iron composite salt.

(B) Preparation of a dispersion containing infrared absorbing organic compound

In 60 parts of 1.5% aqueous solution of polyvinyl alcohol was dispersed 30 parts of 3,3-bis[1,1-bis(4-pyrrolidinophenyl)ethylene-2-yl]-4,5,6,7-tetrachlorophthalide. The mixture was pulverized by a sand mill to obtain a dispersion of particles 5.0μ in average size containing infrared absorbing organic compound.

(C) Preparation of a coating composition for an under sheet, and an under sheet

To 120 parts of water were added 25 parts of sodium polyacrylate (trade name "Poise 520", product of Kao Corporation, 40% concentration), 25 parts (as solids) of the above composite iron salt slurry, 2.3 parts (as solids) of the above dispersion containing infrared absorbing organic compound and 73 parts of precipitated calcium carbonate with vigorous stirring to prepare a dispersion. To the dispersion was added 26 parts of carboxyl-modified styrene-butadine copolymer latex (50% concentration) to obtain a coating composition for an under sheet.

The coating composition was applied by an air knife coater to a paper substrate weighing 90 g/m$^2$ in an amount of 10 g/m$^2$ by dry weight to prepare an under sheet. The coated layer of the under sheet contained about 2.5 millimoles/m$^2$ of the iron (III) compound and about 0.2 millimole/m$^2$ of infrared absorbing organic compound.

(Evaluation)

The above top sheet was superposed on the above under sheet with their coating surfaces opposed to each other, the assembly was pressed by a press machine for color formation. The recorded image on the coated surface of the under sheet and the background area thereof were checked for reflectivity at 840 nm with use of a spectrophotometer (UVIDEC-505, product of Japan Spectroscopic Co., Ltd.). PCS value was 0.56 by the above-mentioned equation.

EXAMPLE 2

Preparation of a dispersion of a molten mixture containing infrared absorbing organic compound, and an under sheet In 90 parts of molten dimethyl terephthalate at 150° C. was dissolved 10 parts of 3,3-bis[1,1-bis(4-pyrrolidinophenyl)ethylene-2-yl]-4,5,6,7-tetrachlorophthalide and the molten mixture was cooled and pulverized. The obtained powder was dispersed in 200 parts of 1.5% aqueous solution of polyvinyl alchol and the mixture was pulverized by a sand mill to obtain a dispersion of particles 5.0μ in average size containing the above molten mixture.

An under sheet was obtained in the same manner as in Example 1 except that 23 parts (as solids) of the above dispersion was used for infrared absorbing organic compound dispersion and the amount of precipitated calcium carbonate was changed from 73 parts to 52 parts. The coated layer of the under sheet contained about 2.5 millimoles/m$^2$ of the iron (III) compound and about 0.2 millimole/m$^2$ of infrared absorbing organic compound.

(Evaluation)

Evaluation was made in the same manner as in Example 1 with use of the above under sheet and a top sheet obtained in Example 1. PCS value was 0.64.

EXAMPLE 3

An under sheet was prepared in the same manner as in Example 2 except that 90 parts of tribenzylamine was used in place of 90 parts of dimethyl terephthalate. Evaluation was made in the same manner as in Example 1 with use of the under sheet and a top sheet of Example 1. PCS value was 0.71.

EXAMPLE 4

Preparation of microcapsules containing infrared absorbing organic compound, and an under sheet A 10 parts quantity of 3,3-bis[1,1-bis(4-pyrrolidinophenyl)ethylene-2-yl]-4,5,6,7-tetrachlorophthalide was dissolved in a mixture of 45 parts of diethyl adipate and 45 parts of di-n-butyl adipate. To the solution was added 40 parts (as solids) of methoxymethylolmelamine resin precondensate containing hexamethoxyhexamethylolmelamine as a main component (trade name, "Cymel 350", product of Mitsui Toatsu Chemicals, Inc.) to obtain an inner-phase oil.

To a vessel equipped with a heater and stirrer was added an aqueous solution prepared by dissolving 6 parts of ethylene-maleic anhydride copolymer (trade name, "EMA-31", product of Monsanto Co., Ltd.) in 200 parts of water with heating. Thereto was added 5% aqueous solution of sodium hydroxide to adjust a pH to 4.5 to obtain an aqueous medium for preparing microcapsules.

To the aqueous medium heated to 95° C. was added the above inner-phase oil to obtain an emulsion containing particles 7.0μ in average size and the emulsion was reacted at 95° C. for 1 hour to prepare a microcapsule dispersion containing infrared absorbing organic compound.

An under sheet was obtained in the same manner as in Example 1 except that 30 parts (as solids) of the above capsule dispersion was used for infrared absorbing organic compound dispersion and the amount of precipitated calcium carbonate was changed from 73 parts to 45 parts. The coated layer of the under sheet contained about 2.5 millimoles/m$^2$ of the iron (III) compound and about 0.2 millimole/m$^2$ of infrared absorbing organic compound.

(Evaluation)

Evaluation was made in the same manner as in Example 1 with use of the above under sheet and a top sheet obtained in Example 1. PCS value was 0.73.

EXAMPLE 5

A microcapsule dispersion containing infrared absorbing organic compound was prepared in the same manner as in Example 4 except that a mixture of 30 parts of dimethyl phthalate, 30 parts of tribenzylamine and 30 parts of N,N-dibenzyl-β-aminoethanol was used in place of a mixture of 45 parts of diethyl adipate and 45 parts of di-n-butyl adipate.

An under sheet was obtained in the same manner as in Example 4 except that 30 parts (as solids) of the above microcapsule dispersion is used in place of the microcapsule dispersion of Example 4.

(Evaluation)

Evaluation was made in the same manner as in Example 1 with use of the above under sheet and a top sheet obtained in Example 1. PCS value was 0.77. After the recorded image was subjected directly to sunlight for 3 hours, PCS value was 0.71.

COMPARISON EXAMPLE 1

An under sheet was prepared in the same manner as in Example 5 except that the microcapsule dispersion containing infrared absorbing organic compound was not used and the amount of precipitated calcium carbonate was changed from 45 parts to 75 parts.

(Evaluation)

Evaluation was made in the same manner as in Example 1 with use of the above under sheet and a top sheet obtained in Example 1. PCS value was 0.46. After the recorded image was subjected directly to sunlight for 3 hours, PCS value was 0.44.

COMPARISON EXAMPLE 2

An under sheet was prepared in the same manner as in Example 5 except that the iron (III) compound slurry was not used and the amount of precipitated calcium carbonate was changed from 45 parts to 70 parts.

(Evaluation)

Evaluation was made in the same manner as in Example 1 with use of the above under sheet and a top sheet obtained in Example 1. PCS value was 0.30. After the recorded image was subjected directly to sunlight for 3 hours, PCS value was 0.10.

From Example 5 and Comparison Examples 1 and 2, the record image was proved to be remarkably improved in lightfastness by conjoint use of both record materials.

EXAMPLES 6 AND 7

Two kinds of microcapsule dispersions containing ligand compound and two kinds of top sheets were obtained in the same manner as in Example 1 except that each 30 parts of laurylbenzene-3,4-dithiol (Example 6) and 2-lauryl-8-hydroxyquinoline (Example 7) was used in place of 30 parts of lauryl gallate, as a ligand compound.

Evaluation was made in the same manner as in Example 1 with use of each of the above top sheet and an under sheet of Example 5. PCS value were 0.76 and 0.67 respectively in Examples 6 and 7.

EXAMPLES 8 TO 15

Eight kinds of microcapsule dispersions containing infrared absorbing organic compound and eight kinds of under sheets were prepard in the same manner as in Example 5 except that each 10 parts of the following infrared absorbing organic compounds was used in place of 10 parts of 3,3-bis[1,1-bis(4-pyrrolidinophenyl-)ethylene-2-yl]-4,5,6,7-tetrachlorophthalide. PCS value were also measured in the same manner as in Example 5.

Ex. 8: 3,3-bis[1,1-bis(4-pyrrolidinophenyl)ethylene-2-yl]-4,7-dichloro-5,6-dibromophthalide, PCS value=0.78.

Ex. 9: 3,3-bis[1,1-bis(4-pyrrolidinophenyl)ethylene-2-yl]-5-chloro-4,6,7-tribromophthalide, PCS value=0.76.

Ex. 10: 3,3-bis[1,1-bis(4-pyrrolidinophenyl)ethylene-2-yl]-6-chloro-4,5,7-tribromophthalide, PCS value=0.77.

Ex. 11: 3,3-bis[1,1-bis(julolidine-5-yl)ethylene-2-yl]-4,5,6,7-tetrachlorophthalide, PCS value=0.75.

Ex. 12: 3,3-bis[1,1-bis(4-morpholinophenyl)ethylene-2-yl]-4,5,6,7-tetrachlorophthalide, PCS value=0.76.

Ex. 13: 3,3-bis[1,1-bis(4-dimethylaminophenyl)ethylene-2-yl]-6-azaphthalide, PCS value=0.75.

Ex. 14: 3,6,6'-trisdimethylamino-spiro(fluorene-9,3'-phthalide), PCS value=0.73.

Ex. 15: 3,6'-bisdiethylamino-6-dimethylamino-spiro(-fluorene-9,3'-phthalide), PCS value=0.72.

EXAMPLE 16

To 1600 parts of 5% aqueous solution of sodium hydroxide was added 356 parts of tert-butylbenzoic acid. Thereto was added an aqueous solution of 180 parts of $FeCl_3.6H_2O$ in 500 parts of water with vigorous stirring to prepare a dispersion containing dark brown particles. The dispersion was filtered and washed with water to obtain a slurry.

An under sheet was prepared in the same manner as in Example 5 except that 25 parts (as solids) of the above slurry was used in place of the organic phosphorus-iron composite salt. Evaluation was made in the same manner as in Example 5. Although colored in light brown in the coated surface, the under sheet has an excellent PCS value of 0.76.

EXAMPLE 17

In 280 parts of water was dissolved 19.4 parts of sodium metavanadate with heating and thereafter cooled with cold water. Separately, in 200 parts of water was dissolved 35.3 parts of dodecylbenzyltrimethylammonium chloride and then cooled with cold water. The latter solution was placed into a separable flask equipped with a drop funnel and a stirrer. The former solution was added gradually through the drop funnel to the separable flask to obtain pale yellow precipitates. The precipitate was filtered by means of suction, washed with water and dried at 50° C. at a reduced pressure to obtain a vanadium compound as a viscous solid.

In 38 parts of benzyl ether was dissolved 38 parts of the above solid with heating. The solution was added to 200 parts of 1.5% aqueous solution of polyvinyl alcohol heated to 80° C. and the mixture was emulsified to obtain a dispersion of particles 5$\mu$ in average size.

An under sheet was prepared in the same manner as in Example 5 except that 25 parts (as solids) of the above dispersion containing the vanadium compound was used in place of the iron (III) compound. Evaluation was made in the same manner as in Example 5. PCS value was 0.75.

EXAMPLE 18

Preparation of microcapsules containing infrared absorbing organic compound

A microcapsule dispersion containing infrared absorbing organic compound was prepared in the same manner as in Example 4 except that 10 parts of 1,1'-diethyl-2,2'-quino-tricarbocyanine chloride was used in place of 10 parts of 3,3-bis[1,1-bis(4-pyrrolidinophenyl-)ethylene-2-yl]-4,5,6,7-tetrachlorophthalide.

Preparation of microcapsules containing an iron (III) compound, and a top sheet

An iron (III) compound slurry was prepared in the same manner as in Example 16 and dried. A microcapsule dispersion containing the iron (III) compound was prepared in the same manner as in Example 4 except that 10 parts of the above iron salt was used in place of 10 parts of 3,3-bis[1,1-bis(4-pyrrolidinophenyl)ethylene-2-yl]-4,5,6,7-tetrachlorophthalide.

The above microcapsule dispersion containing infrared absorbing organic compound was mixed with the above microcapsule dispersion containing the iron (III) compound. Thereto were added 40 parts of wheat starch powder and 20 parts of pulp powder. Water was added thereto in such amount as to achieve 22% solids concentration to obtain a capsule coating composition.

The coating composition was applied by an air knife coater to a paper substrate weighing 40 g/m$^2$ in an amount of 10 g/m$^2$ by dry weight to prepare a top sheet.

Preparation of an under sheet

To 120 parts of water were added 5 parts of sodium polyacrylate, 30 parts of lauryl gallate and 70 parts of precipitated calcuim carbonate with vigorous stirring to prepare a dispersion. To the dispersion was added 26 parts of carboxyl-modified styrene-butadiene copolymer latex (50% concentration) to obtain a coating composition for an under sheet.

The coating composition was applied by an air knife coater to a paper substrate weighing 90 g/m$^2$ in an amount of 10 g/m$^2$ by dry weight to prepare an under sheet.

(Evaluation)

Evaluation was made in the same manner as in Example 1 with use of the above top sheet and under sheet. PCS value was 0.62. When the under sheet was subjected directly to sunlight for 3 hours, the coated surface turned in yellowish brown.

EXAMPLE 19

A microcapsule dispersion containing infrared absorbing organic compound prepared in the same manner as in Example 5 was mixed with a microcapsule dispersion containing the iron (III) compound prepared in the same manner as in Example 18.

Thereto were added 40 parts of wheat starch powder and 20 parts of pulp powder. Water was added thereto in such amount as to achieve 23% solids concentration to obtain a capsule coating composition.

The coating composition was applied by an air knife coater to a paper substrate weighing 40 g/m$^2$ in an amount of 10 g/m$^2$ by dry weight to prepare a top sheet.

Evaluation was made in the same manner as in Example 1 with use of the under sheet obtained in Example 18 and the above top sheet. PCS value was 0.67. When the under sheet was subjected directly to sunlight for 3 hours, the coated surface turned in yellowish brown.

EXAMPLE 20

To the rear surface of the under sheet of Example 5 was applied by an air knife coater the coating composition for a top sheet of Example 1 in an amount of 10 g/m$^2$ by dry weight to obtain a middle sheet.

(Evaluation)

The above middle sheet was placed between the top sheet and under sheet of Example 5 and the assembly was pressed by a press machine for color formation. The record images on the middle sheet and under sheet, and the background area thereof were checked for reflectivity in the same manner as in Example 1. PCS values were 0.80 and 0.76 respectively.

EXAMPLE 21

The microcapsule dispersion containing infrared absorbing organic compound of Example 5 was applied by an air knife coater to a paper substrate weighing 40 g/m$^2$ in an amount of 6 g/m$^2$ by dry weight. To the coated surface was applied by an air knife coater the coating composition for an under sheet of Comparison Example 1 in an amount of 8 g/m$^2$ by dry weight to obtain an under sheet.

Evaluation was made in the same manner as in Example 1 with use of the top sheet of Example 1 and the above under sheet. PCS value was 0.74.

EXAMPLE 22

To the rear surface of the under sheet of Example 21 was applied by an air knife coater the coating composition for a top sheet of Example 1 in an amount of 10 g/m$^2$ by dry weight to obtain a middle sheet.

Evaluation was made in the same manner as in Example 20 except that the above middle sheet was used. PCS values for the middle sheet and under sheet were 0.76 and 0.74 respectively.

EXAMPLE 23

The coating compositions for a top sheet and an under sheet prepared in the same manner as in Example 1 were mixed to obtain a coating composition. The coating composition was applied by an air knife coater to a paper substrate weighing 90 g/m$^2$ in an amount of 12 g/m$^2$ by dry weight to obtain self-contained type pressure sensitive manifold sheet.

(Evaluation)

The above self-contained type pressure sensitive manifold sheet was pressed by a press machine for color formation. The record image on the coated surface and the background area thereof were checked for reflectivity in the same manner as in Example 1. PCS value was 0.53.

EXAMPLE 24

A self-contained type pressure sensitive manifold sheet was prepared in the same manner as in Example 23 with use of the coating composition for a top sheet obtained in Example 1 and the coating composition for an under sheet obtained in Example 2. PCS value was 0.63.

EXAMPLE 25

A self-contained type pressure sensitive manifold sheet was prepared in the same manner as in Example 23 with use of the coating composition for a top sheet obtained in Example 1 and the coating composition for an under sheet obtained in Example 3. PCS value was 0.70.

EXAMPLE 26

A self-contained type pressure sensitive manifold sheet was prepared in the same manner as in Example 23 with use of the coating composition for a top sheet obtained in Example 1 and the coating composition for an under sheet obtained in Example 4. PCS value was 0.72.

EXAMPLE 27

A self-contained type pressure sensitive manifold sheet was prepared in the same manner as in Example 23 with use of the coating composition for a top sheet obtained in Example 1 and the coating composition for an under sheet obtained in Example 5. PCS value was 0.75.

EXAMPLE 28

To the coated surface of the top sheet obtained in Example 1 was applied the coating composition for an under sheet obtained in Example 5 by an air knife coater in an amount of 10 g/m$^2$ by dry weight to prepare self-contained type pressure sensitive manifold sheet. PCS value was 0.76.

EXAMPLE 29

The microcapsule coating composition containing a ligand compound of Example 1 was mixed with the microcapsule dispersion containing infrared absorbing organic compound of Example 5 to prepare a coating composition. The coating composition was applied by an air knife coater to a paper substrate weighing 40 g/m$^2$ in an amount of 8 g/m$^2$ by dry weight. To the coated surface was applied the coating composition for an under sheet of Comparison Example 1 by an air knife coater in an amount of 8 g/m$^2$ by dry weight to prepare self-contained type pressure sensitive manifold sheet. PCS value was 0.74.

EXAMPLE 30

The microcapsule dispersion containing infrared absorbing organic compound of Example 5 was applied by an air knife coater to a paper substrate weighing 40 g/m$^2$ in an amount of 8 g/m$^2$ by dry weight. To the coated surface was applied by an air knife coater a coating composition obtained by mixing the coating composition for an under sheet of Comparison Example 1 and the coating composition for a top sheet of Example 1 in an amount of 10 g/m$^2$ to obtain self-contained type pressure sensitive manifold sheet. PCS value was 0.73.

EXAMPLE 31

Preparation of a top sheet (first sheet)

In 100 parts of dimethyl phthalate was dissolved with heating 5 parts of 4,4'-bis-dimethylaminobenzhydrol-p-toluenesulfinate to obtain an inner-phase oil. A microcapsule coating composition containing an electron donating chromogenic material was prepared in the same manner as in Example 1 except that the above inner-phase oil was used in place of the inner-phase oil in the preparation of a microcapsule coating composition containing a ligand compound. The microcapsule coating composition was applied by an air knife coater to a paper substrate weighing 40 g/m$^2$ in an amount of 4 g/m$^2$ by dry weight to obtain a top sheet (first sheet).

Preparation of a middle sheet (second sheet)

To 120 parts of water were added 3 parts of sodium polyphosphate, 80 parts of activated clay and 20 parts of precipitated calcium carbonate with vigorous stirring to prepare a dispersion. To the dispersion was added 40 parts of carboxyl-modified styrene-butadiene copolymer latex (50% concentration) to obtain a color developing coating composition.

The coating composition was applied by an air knife coater to a paper substrate weighing 40 g/m$^2$ in an amount of 7 g/m$^2$ by dry weight. To the opposite surface of the paper substrate was applied the microcapsule coating composition containing a ligand compound of Example 1 by an air knife coater in an amount of 12 g/m$^2$ by dry weight to obtain a middle sheet (second sheet).

(Evaluation)

The above top sheet (first sheet), middle sheet (second sheet) and under sheet (third sheet) of Example 5 were superposed in this order, and the assembly was pressed by a press machine for color formation. Excellent record images were obtained on the second and third sheets. The sheets as superposed were treated under a condition of 50° C. and 90% RH for 48 hours, but the record images hardly changed in color density.

EXAMPLE 32

Preparation of a top sheet (first sheet)

The coating composition for an under sheet of Comparison Example 1 was mixed with the coating composition for a top sheet of Example 1 to prepare a coating composition for self-contained type pressure sensitive manifold sheet. The coating composition was applied by an air knife coater to a paper substrate weighing 40 g/m$^2$ in an amount of 10 g/m$^2$. To the opposite surface of the paper substrate was applied the coating composition for a top sheet of Example 1 by an air knife coater in an amount of 6 g/m$^2$ by dry weight to obtain a top sheet (first sheet).

Preparation of a middle sheet (second sheet)

To the opposite surface of the under sheet of Comparison Example 1 was applied the coating composition for a top sheet of Example 1 by an air knife coater in an amount of 10 g/m$^2$ by dry weight to obtain a middle sheet (second sheet).

(Evaluation)

The above top sheet (first sheet), middle sheet (second sheet) and under sheet (third sheet) of Example 5 were superposed in this order, and the assembly was pressed by a press machine for color formation. Excellent record images were obtained on the first, second and third sheets. The sheets as superposed were treated under a condition of 50° C. and 90% RH for 48 hours, but the record images hardly changed in color density.

We claim:

1. In a pressure sensitive manifold sheet comprising a substrate which is coated on one surface thereof with a coating composition containing (a) at least one of an iron (III) compound and a vanadium compound {(a) component} and a coating composition containing (b) an aromatic compound having at least one of hydroxyl group and mercapto group on the aromatic ring {(b) component} in the form of superposed layers or a layer of the mixture of these two coating compositions, or comprising substrates in which a layer of one of the coating compositions is formed on a surface of one substrate and a layer of the other coating composition is formed on a surface of another substrate, or comprising a substrate provided with a layer of one of the coating compositions and a separate layer of the other coating composition on the opposite surfaces thereof, and which forms a color when pressed, the improvement comprising at least one infrared absorbing organic compound selected from the group consisting of (c-1) an organic compound having an absorption in the infrared region, and (c-2) an electron donating chromogenic material which reacts with the above aromatic compound {(b) component} to form a color having an absorption in the infrared region contained in any of the above coating composition layers, or in another layer adjacent to one of the coating composition layers, wherein the infrared absorbing organic compound contained in the coating composition layer or in said another layer adjacent to the coating composition layer has been dissolved or melted in a hydrophobic medium.

2. Sheet of claim 1, wherein said sheet is a self-contained type manifold sheet or a transfer type manifold sheet.

3. A self-contained type pressure sensitive manifold sheet as defined in claim 2, wherein the sheet comprises a substrate which is coated on one surface thereof with the coating composition containing (a) component and the coating composition containing (b) component in the form of superposed layers or a layer of the mixture of these two coating compositions, and in which at least one infrared absorbing organic compound selected from the group consisting of (c-1) component and (c-2) component is contained in any one of said coating composition layers or in another layer adjacent to one of said coating composition layers.

4. A transfer type pressure sensitive manifold sheet as defined in claim 2, wherein the sheet comprises substrates in which a layer of one of the coating compositions is formed on a surface of one substrate and a layer of the other coating composition is formed on a surface of another substrate, or comprising a substrate provided with a layer of one of the coating compositions and a separate layer of the other coating composition on the opposite surfaces thereof, and in which at least one infrared absorbing organic compound selected from the group consisting of (c-1) component and (c-2) component is contained in any one of the said coating composition layers, or in another layer adjacent to one said coating composition layer.

5. A transfer type pressure sensitive manifold sheet as defined in claim 2, wherein the sheet comprises an oil transfer sheet coated thereon with a coating composition comprising microcapsule containing said (b) component and an oil accepting sheet coated thereon with a coating composition containing said (a) component and said (c-2) component.

6. A transfer type pressure sensitive manifold sheet as defined in claim 5 which further comprises a substrate provided with a layer of a coating composition containing said (a) component and said (c-2) component on one surface thereof, and a separate layer of a coating composition comprising microcapsules containing said (b) component on the opposite surface thereof.

7. A transfer type pressure sensitive manifold sheet as defined in claim 2, wherein the sheet comprises an oil transfer sheet coated thereon with a coating composition comprising microcapsules containing said (b) component and an oil accepting sheet coated thereon with a coating composition containing said (a) component and a second coating composition containing said (c-2) component in the form of superposed layers.

8. A transfer type pressure sensitive manifold sheet as defined in claim 7, which further comprises a substrate coated on one surface thereof with a coating composition containing said (a) component and a second coating composition containing said (c-2) component in the form of superposed layers, said substrate being coated on the opposite surface thereof with a coating composition comprising microcapsules containing said (b) component.

9. A self-contained type pressure sensitive manifold sheet as defined in claim 2, wherein the sheet comprises a substrate which is coated on one surface thereof with a coating composition comprising microcapsules containing said (b) component and a second coating composition containing a (a) component and said (c-2) component in the form of superposed layers.

10. A self-contained type pressure sensitive manifold sheet as defined in claim 2, wherein the sheet comprises a substrate which is coated on one surface thereof with a coating composition containing said (a) component and a second coating composition containing said (c-2) component and microcapsules containing said (b) component in the form of superposed layers.

11. A self-contained type pressure sensitive manifold sheet as defined in claim 2, wherein the sheet comprises a substrate which is coated on one surface thereof with a coating composition containing said (a) component, said (c-2) component and microcapsules containing said (b) component.

12. A self-contained type pressure sensitive manifold sheet as defined in claim 2, wherein the sheet comprises a substrate which is coated on one surface thereof with a coating composition containing said (a) component and microcapsules containing said (b) component and a second coating composition containing said (c-2) component in the form of superposed layers.

13. A pressure sensitive manifold sheet as defined in claim 1, wherein said (a) component, said (b) component and the infrared absorbing organic compounds are each present on the substrate in an amount of 0.2 to 35 millimoles, 0.3 to 30 millimoles and 0.01 to 10 millimoles respectively per square meter of the substrate.

14. A pressure sensitive manifold sheet as defined in claim 1, wherein the infrared absorbing organic compound is enclosed in microcapsules.

15. A pressure sensitive manifold sheet as defined in claim 1, wherein 10 to 100% by weight of the hydrophobic medium is at least one member selected from the group consisting of alcohols, ester,s organic phosphorus compounds, ethers, ketones, acid amides, carbonates, thiols, sulfides, disulfides and organic bases which are selected from the group consisting of aliphatic amine, aromatic amine, alicyclic amine, amidine, guanidine, nitrogen-containing heterocyclic compound and heterocyclic amine.

16. A pressure sensitive manifold sheet as defined in claim 15, wherein 10 to 100% by weight of hydrophobic medium is at least one of said organic bases.

17. A pressure sensitive manifold sheet as defined in claim 1, wherein the infrared absorbing organic compound has been dissolved or melted in an amount of 1 to 100 parts by weight of said compound per 100 parts by weight of the hydrophobic medium.

18. A pressure sensitive manifold sheet as defined in claim 1, wherein the infrared absorbing organic compound consists essentially of (c-2) component.

19. A pressure sensitive manifold sheet as defined in claim 18, wherein said (c-2) component is a compound represented by the formula [XXIX]

[XXIX]

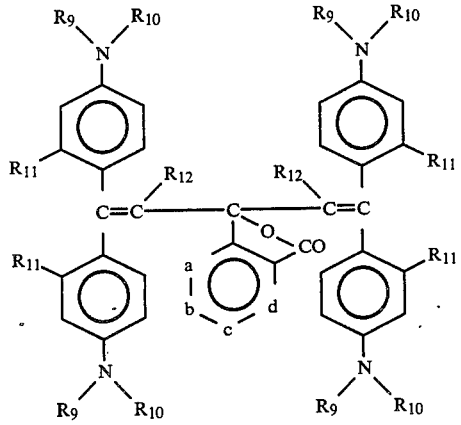

wherein $R_9$ and $R_{10}$ are each an alkyl group, alicyclic group, aryl group or aralkyl group which is unsubstituted or substituted with a halogen atom, alkyl group or alkoxyl group, $R_9$ and $R_{10}$ may form a hetero ring when taken together or together with the benzene ring adjacent thereto, $R_{11}$ is a hydrogen atom, halogen atom, alkyl group, alkoxyl group or acyloxy group, $R_{12}$ is a hydrogen atom or alkyl group, a, b, c and d are each a carbon atom or a nitrogen atom, with at least two of a, b, c and d being carbon atoms, each of the carbon atoms a to d may have a hydrogen atom, halogen atom, alkyl group, alkoxyl group, dialkylamino group or nitro group attached thereto as a substitute, and the a-b, b-c, or c-d linkage may form another aromatic ring, or a compound represented by the formula [XXX]

[XXX]

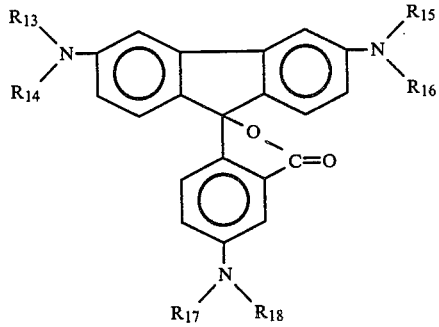

wherein $R_{13}$, $R_{14}$, $R_{15}$, $R_{16}$, $R_{17}$, and $R_{18}$ are each an alkyl group having 1 to 4 carbon atoms.

20. A pressure sensitive manifold sheet as defined in claim 1, wherein the iron (III) compound has at least one P—O . . . $Fe^{3+}$ bond or P—S—$Fe^{3+}$ bond in the molecule.

* * * * *